United States Patent [19]

Yoshimura et al.

[11] Patent Number: 4,465,525

[45] Date of Patent: Aug. 14, 1984

[54] FERRITIC STAINLESS STEEL HAVING EXCELLENT FORMABILITY

[75] Inventors: Hirofumi Yoshimura, Fukuoka; Mitsuo Ishii; Tadashi Sawatani, both of Hikari; Shigeru Minamino, Yamaguchi, all of Japan

[73] Assignee: Nippon Steel Corporation, Japan

[21] Appl. No.: 453,954

[22] Filed: Dec. 28, 1982

Related U.S. Application Data

[63] Continuation-in-part of Ser. No. 238,359, Feb. 25, 1981, abandoned.

[30] Foreign Application Priority Data

Mar. 1, 1980 [JP] Japan ..... 55-24638

[51] Int. Cl.[3] ..... C22C 38/32; C22C 38/54

[52] U.S. Cl. ..... 148/37; 75/124; 75/125; 75/126 P; 75/128 F

[58] Field of Search ..... 75/124, 126 P, 128 T, 75/128 F, 128 V, 128 Z; 148/12 EA, 37

[56] References Cited

U.S. PATENT DOCUMENTS

| | | | |
|---|---|---|---|
| 2,590,835 | 4/1952 | Kirkby et al. | 75/126 P |
| 2,848,323 | 8/1958 | Harris et al. | 75/126 P |
| 3,753,788 | 8/1973 | Fogarty et al. | 148/12 EA |
| 3,778,316 | 12/1973 | Pinnow et al. | 75/128 T |
| 3,856,515 | 12/1974 | Brandis et al. | 75/126 P |
| 3,890,143 | 6/1975 | Skoglund et al. | 75/128 T |
| 3,957,544 | 5/1976 | Pinnow et al. | 75/128 T |
| 4,155,752 | 5/1979 | Oppenheim et al. | 75/124 |

FOREIGN PATENT DOCUMENTS

| | | | |
|---|---|---|---|
| 55-717 | 1/1977 | Japan | 148/12 EA |
| 2071148 | 9/1981 | United Kingdom | 75/126 F |

*Primary Examiner*—Peter K. Skiff

*Attorney, Agent, or Firm*—Wenderoth, Lind & Ponack

[57] ABSTRACT

A ferritic stainless steel having excellent formability, for example, in a deep drawing procedure, contains 0.04 to 0.1 weight % of C, 1.0 weight % or less of Si, 0.75 weight % or less of Mn, 10 to 30 weight % of Cr, 0.5 weight % or less of Ni, 0.025 weight % or les of N, 2 to 30 ppm of boron, and optionally, 0.005 to 0.4 weight % of an additional alloy component consisting of Al and, further optionally, a further additional alloy component consisting of at least one member selected from 0.005 to 0.6 weight % of Ti, 0.005 to 0.4 weight % of Nb, V, and Zr, 0.02 to 0.50 weight % of Cu, and 0.05 weight % or less of Ca and Ce, the sum of the contents of C and N being 0.0502 weight % or more.

5 Claims, 3 Drawing Figures

FERRITIC STAINLESS STEEL HAVING EXCELLENT FORMABILITY

This is a continuation-in-part application from the application, Ser. No. 238,359, filed on Feb. 25, 1981, and now abandoned.

FIELD OF THE INVENTION

The present invention relates to a ferritic stainless steel. More particularly, the present invention relates to a ferritic stainless steel having an excellent formability, for example, deep drawability.

BACKGROUND OF THE INVENTION

It is known that conventional types of ferritic stainless steel nickel in a smaller content than that in austenitic stainless steel, and, therefore, are cheap and exhibit a satisfactory accuracy upon being shaped and no stress corrosion cracking. Therefore, ferritic stainless steel is widely used for producing various kinds of kitchenware and parts for automobiles. However, it is also known that conventional ferritic stainless steel exhibits poor formability (deep drawability, capability of being shaped) compared with the austenitic stainless steel. Also, recently, the source of supplies of nickel is becoming exhausted. Therefore, it is strongly desired by the stainless steel industry to provide a new type of ferritic stainless steel having excellent formability and reduced nickel content.

In the past, many attempts have been made to provide new types of ferritic stainless steel having the above-mentioned properties.

For example, in order to enhance the formability of the ferritic stainless steel, Japanese Examined Patent Publication No. 51-44888 provided an aluminum-containing ferritic stainless steel and Japanese Unexamined Patent Publication No. 51-98616 provided an aluminum-titanium-containing ferritic stainless steel. It is true that the addition of a certain amount of an additional alloy component consisting of aluminum alone or aluminum and titanium to a typical ferritic stainless steel base, that is, a 17% chromium ferritic stainless steel (SUS 430 type), is effective for increasing formability, for example, deep drawability. Addition of the amount of the additional alloy component beyond a certain level, however, fails to have any effect. Also, the effect of the addition of aluminum alone or aluminum and titanium is unsatisfactory.

In other attempts, Japanese Examined Patent Publication No. 44-736 discloses a boron-containing ferritic stainless steel and Japanese Examined Patent Publication Nos. 47-4786 and 51-8733 a boron-titanium-containing ferritic stainless steel. The addition of boron alone or boron and titanium is effective for enhancing the formability, for example, deep drawability, of ferritic stainless steel. The amount of the boron added in the above-mentioned attempts, is however, relatively large. The resultant ferritic stainless steel exhibits poor resistance to corrosion and hot workability, because some types of boron compounds are deposited in the grain boundary regions. Also, the large amount of boron substantially increases cost of the resultant ferritic stainless steel, making the above-mentioned type of boron-containing ferritic stainless steel practically useless in industry.

In still another attempt, British Pat. No. 1,217,933 discloses another type of boron-containing ferritic stainless steel. However, this type of boron-containing ferritic stainless steel contains molybdenum, nickel, and cobalt. Here, the addition of boron is intended to improve the surface quality of the primary ferritic stainless steel material, not to enhance the formability of the primary material in any way.

U.S. Pat. No. 3,753,788 discloses a ferritic stainless steel, such as type 434, containing boron and niobium. This U.S. patent describes that niobium and boron are effective for enhancing freedom of the steel from ribbing. Also, the U.S. patent states that boron is effective for restricting the segregation tendency of the ingot structure of the steel and production of coarse grains.

Generally speaking, the phenomenon represented by the term "ribbing" is close in appearance and feature to that of the term "ridging". However, the phenomenon represented by the term "ribbing" should be distinguished from the phenomenon of the term "ridging". The phenomenon of ribbing is created on the steel due to tension applied to the steel during a cold rolling procedure. The phenomenon of ridging is generated on the steel when the steel is pressed after the steel is finally annealed. That is, the phenomenon of ribbing is produced at a smaller degree of processing than that of the phenomenon of ridging. Ribbing may be easily eliminated by adding boron and niobium to the steel in accordance with the U.S. patent so as to refine the cast structure. However, ridging, which is produced at a large degree of processing, cannot be eliminated by the method of the U.S. patent.

Also, ferritic stainless steel should be provided with excellent resistance to ridging in addition to superior deep drawability. To enhance the deep drawability, it is necessary to control the texture of the steel which has been finally annealed. It is impossible to enhance the deep drawability only by refining the cast structure of the steel.

Japanese Unexamined Patent Publication No. 52-717 discloses a ferritic stainless steel containing aluminum and titanium. In this steel, the amounts of carbon and nitrogen are restricted. The invention of the Japanese unexamined patent publication intends to improve the resistance of the steel to ridging and to decrease the surface unevenness of the processed steel. However, since the amounts of carbon and nitrogen are small, the resistance to intergranular corrosion of the welded portions of the steel is unsatisfactory.

SUMMARY OF THE INVENTION

An object of the present invention is to provide a ferritic stainless steel having excellent formability.

The above-mentioned object can be attained by the ferritic stainless steel of the present invention, which comprises: 0.04% to 0.1% by weight of carbon, 1.0% by weight or less of silicon, 0.75% by weight or less of manganese, 10% to 30% by weight of chromium, 0.5% by weight or less of nickel, 0.025% by weight or less of nitrogen, 2 to 30 ppm of boron, and the balance consisting of iron and unavoidable impurities, the sum of the contents of carbon and nitrogen being 0.0502% by weight or more.

The ferritic stainless steel of the present invention may contain an additional alloy component consisting of from 0.005% to 0.4% by weight of aluminum.

The additional alloy component is effective for additionally enhancing the formability, such as deep drawability, of the ferritic stainless steel.

The ferritic stainless steel of the present invention may contain, in addition to the above-mentioned additional alloy component, a further additional alloy component consisting of at least one member selected from the group consisting of 0.005% to 0.6% by weight of titanium, 0.005% to 0.4% by weight of niobium, 0.005% to 0.4% by weight of vanadium, 0.005% to 0.4% by weight of zirconium, 0.02% to 0.50% by weight of copper, 0.05% by weight or less of calcium, and 0.05% by weight or less of cerium.

The further additional alloy component is effective for further additionally enhancing the formability, such as deep drawability, of the aluminum-containing ferritic stainless steel of the present invention.

DETAILED DESCRIPTION OF THE INVENTION

Figure 1:
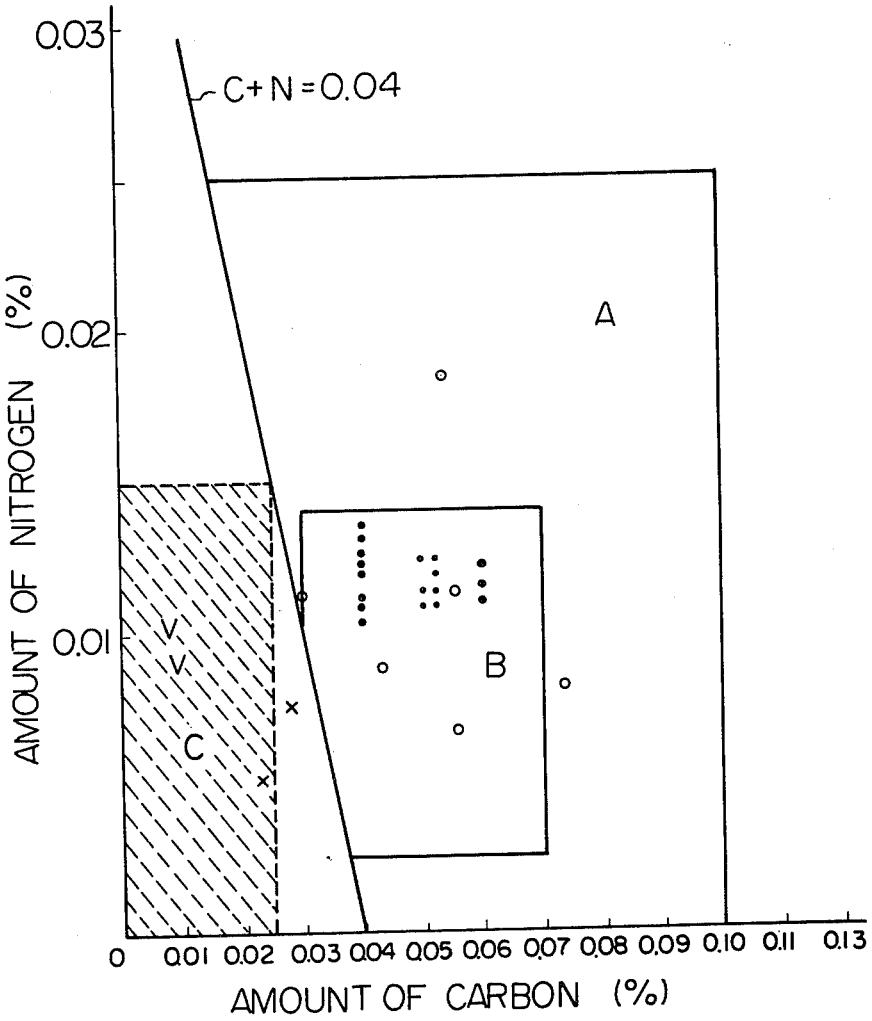
FIG. 1 shows a relationship between the amounts of carbon and nitrogen in the ferritic stainless steel of the invention.

Generally, the formability, such as deep drawability, of steel material can be indicated by using a Lankford's value, that is, an average r value ($\bar{r}$ value). The $\bar{r}$ value is defined by the following equation.

$$\bar{r}=(r_0+2r_{45}+r_{90})/4$$

wherein $r_0$, $r_{45}$, and $r_{90}$ respectively represent r values of the steel material in directions with angles of 0, 45, and 90 degrees from the rolling direction applied to the steel material. Also, the formability can be indicated by using a ridging height which corresponds to a maximum height of ridges formed on the surface of a steel strip when the steel strip has been shaped. In order to exhibit satisfactory formability, it is preferable that the steel strip have an $\bar{r}$ value of 1.1 or more and a ridging height of 18 microns or less. In order to obtain the ferritic stainless steel having an $\bar{r}$ value of 1.1 or more and a ridging height of 18 microns or less, it is very effective to add a very small amount of boron alone or a certain amount of a blend of boron with aluminum or a blend of boron, aluminum, and at least one member selected from Ti, Nb, V, Zr, Cu, Ca, and Ce.

The ferritic stainless steel of the present invention contains, as indispensable components, 0.04% to 0.1% by weight, preferably, 0.04% to 0.07% by weight, of carbon, 1.0% by weight or less, preferably, 0.20% to 0.90% by weight, of silicon, 0.75% by weight or less, preferably, 0.05% to 0.65% by weight of manganese, 0.5% by weight or less, preferably, 0.01% to 0.30% by weight, of nickel, 10% to 30% by weight, preferably, 14% to 25% by weight, of chromium, 0.025% by weight or less, preferably, 0.0025% to 0.014 by weight, of nitrogen, 2to 30 ppm, preferably, 5 to 25 ppm by weight, of boron, and the balance consisting of iron and unavoidable impurities, for example, phosphorus and sulfur, the sum of the contents of carbon and nitrogen being 0.0502% by weight or more.

The effects of the indispensable components except for iron on the property of the resultant ferritic stainless steel are as follows.

Carbon is an effective component for controlling the mechanical properties, for example, tensile strength and ultimate elongation, of the ferritic stainless steel and corrosion resistances, for example, resistance to intergranular corrosion of welded portions thereof. The concentration of carbon in the ferritic stainless steel should be controlled so as to attain the mechanical properties and the corrosion resistances required in the stainless steel. However, an excessive amount of carbon causes the resultant stainless steel to exhibit undesirably decreased elongation and degraded formability. Also, if the content of carbon is excessively small, the welded portions of the resultant stainless steel exhibit unsatisfactory resistance to intergranular corrosion. The present inventors found that when the content of nitrogen is 0.025% by weight or less and the content of carbon is in the range of 0.04% to 0.1% by weight, preferably, 0.04% to 0.07% by weight, the resultant ferritic stainless steel exhibits satisfactory mechanical properties and corrosion resistances. In this case, it is also necessary to control the sum of the contents of carbon and nitrogen to 0.0502% by weight or more.

Silicon is a strong oxygen-eliminating element and, therefore, a certain amount of silicon is added into a melt of a steel in a steelmaking process for the purpose of eliminating oxygen from the steel melt. However, when silicon is used in an excessively large amount, the resultant steel strip contains an undesirably large amount of a $SiO_2$ type impurity. This $SiO_2$ type impurity causes the formablity of the resultant steel to be decreased. Therefore, in the ferritic stainless steel of the present invention, the content of silicon should be 1.0% by weight or less, preferably, in a range of from 0.20% to 0.90%.

Manganese is also used as an oxygen-eliminating agent for the steel. However, an excessively large content of manganese causes the resultant ferritic stainless steel to exhibit an undesirably increased brittleness. Therefore, the content of manganese in the ferritic stainless steel of the present invention should be 0.75% by weight or less, preferably, in a range of from 0.05% to 0.65% by weight.

In the ferritic stainless steel of the present invention, the content of chromium is in the range of from 10% to 30% by weight, preferably, from 14% to 25% by weight. A content of chromium less than 10% by weight causes the resultant stainless steel to exhibit unsatisfactory resistance to corrosion. Also, an amount of chromium over the upper limit, 30% by weight, is not effective for increasing the resistance of the stainless steel to corrosion to more than that of stainless steel containing 30% by weight of chromium.

In ferritic stainless steel, nickel is usually used in a small amount. That is, a content of nickel of 0.5% by weight or less enhances the toughness of the resultant ferritic stainless steel. An amount of nickel over 0.5% by weight is not effective for enhancing the toughness to more than that of the stainless steel containing 0.5% by weight of nickel. Usually, it is preferable that the content of nickel in the ferritic stainless steel of the present invention be in a range of from 0.01% to 0.30% by weight.

Nitrogen contained in the ferritic stainless steel is remarkably effective for enhancing the mechanical properties, for example, tensile strength and toughness, of the stainless steel. However, an excessive addition of nitrogen causes the resultant ferritic stainless steel to exhibit undesirably increased brittleness, and, therefore, degraded formability. Therefore, in the ferritic stainless steel of the present invention, the content of nitrogen is limited to 0.025% by weight or less, preferably, from 0.0025% to 0.014% by weight.

The scope A of the limited amounts of carbon and nitrogen in the ferritic stainless steel of the present invention and the scope B of the preferable amounts thereof are shown in FIG. 1. Also, FIG. 1 shows the scope C of the amounts of carbon and nitrogen disclosed in Japanese Unexamined Patent Publication No. 52-717.

In FIG. 1, the solid dots indicate the amounts of nitrogen and carbon in the ferritic stainless steel strips of Examples 1 through 20, the hollow dots indicate those of Examples 21 through 26, the crosses indicate those of Comparative Examples 6 and 7, and the V's indicate those of the above-mentioned Japanese patent publication.

Also, it is necessary that the sum of the contents of carbon and nitrogen be 0.0502% by weight or more.

When the ferritic stainless steel is welded, the resistance of the resultant welded portion to intergranular corrosion depends on the sum of the contents of carbon and nitrogen. If the sum of the contents of carbon and nitrogen is smaller than 0.04% by weight, the resultant ferritic stainless steel sometimes exhibits unsatisfactory resistance to intergranular corrosion of the welded portion thereof.

Figure 2:
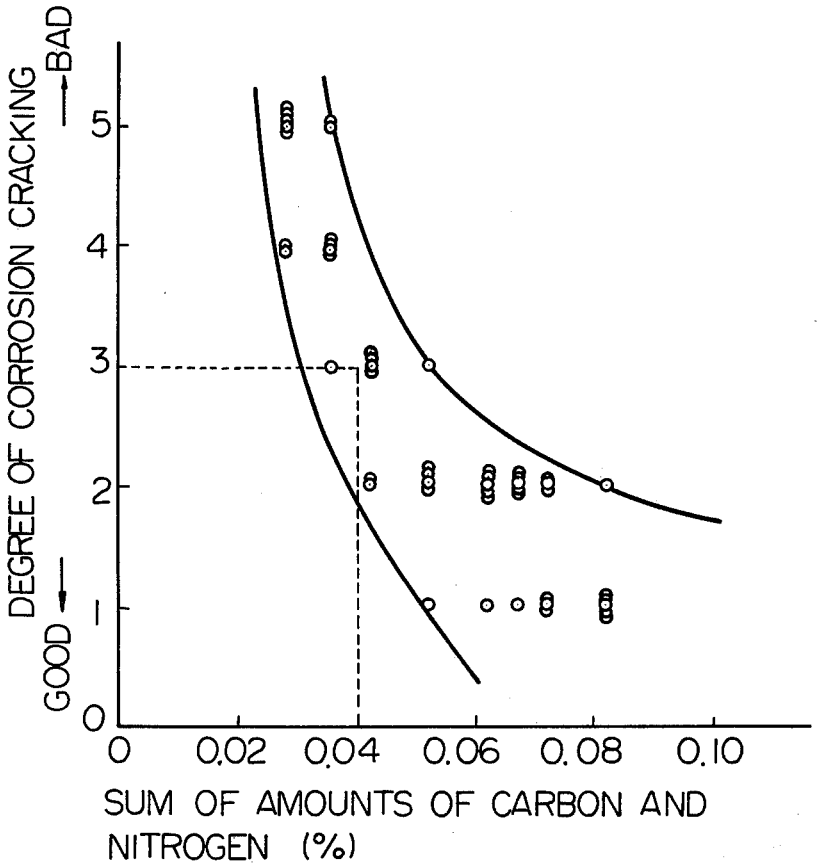
FIG. 2 shows a relationship between the amounts of carbon and nitrogen in the ferritic stainless steel and the degree of intergranular corrosion of welded portions thereof.

The relationship between the amounts of carbon and nitrogen in the ferritic stainless steel and the degree of corrosion cracking of the welded portions of the ferritic stainless steel is shown in FIG. 2. In FIG. 2, the ferritic stainless steel having a degree of intergranular corrosion of 3 or less can be in practically used. According to FIG. 2, the ferritic stainless steel must have a sum of the amounts of carbon and nitrogen of 0.0502% or more.

In the ferritic stainless steel containing 0.025% by weight or less of nitrogen, boron in an amount of 2 to 30 ppm forms deposits of boron nitride and is effective for increasing the elongation and the $\bar{r}$ value and decreasing the ridging height of the ferritic stainless steel and, therefore, enhancing the formability, such as deep drawability, of the ferritic stainless steel. The above-mentioned effects appear when boron is added in an amount of 2 ppm or more to the ferritic stainless steel. An amount of boron above 30 ppm, however, is not effective for increasing the above-mentioned effects to more than that of a 30 ppm boron-containing stainless steel and, sometimes, causes a slight decrease of the above-mentioned effects on the resultant stainless steel. Also, excessive boron causes some types of boron compounds to be deposited in the boundary regions between grains in the resultant ferritic stainless steel. The above-mentioned phenomenon results in a decreased resistance to corrosion and a degraded hot formability of the resultant ferritic stainless steel. Also, the use of a large amount of boron, which is expensive, causes the price of the resultant ferritic stainless steel to be high. Accordingly, the content of boron in the ferritic stainless steel of the present invention is limited to a range of from 2 to 30 ppm, preferably, 5 to 25 ppm.

Figure 3:
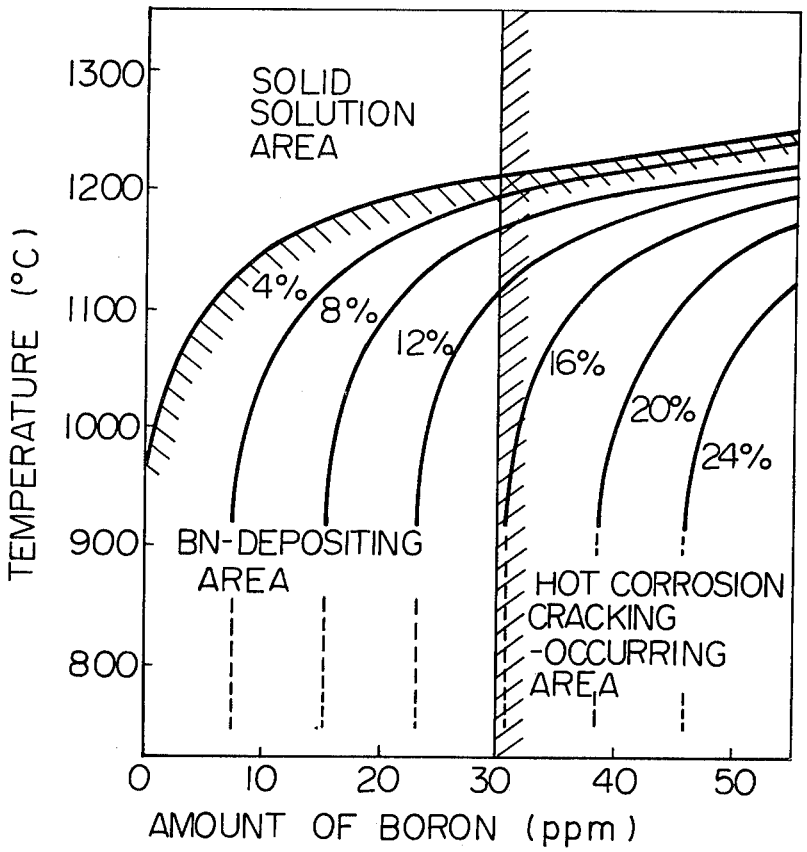
FIG. 3 shows a relationship between the temperature and the amount of boron in the ferritic stainless steel when the content of nitrogen is 0.025% by weight or less.

In order to enhance the deep drawability of the finally annealed stainless steel, it is necessary to control the texture of the stainless steel plate so as to increase the pole density thereof in the (111) direction or close thereto. In the present invention, boron nitride (BN) is effectively utilized for the above-mentioned purpose. FIG. 3 shows a relationship between the temperature and the amount of boron in the ferritic stainless steel when the content of nitrogen in the stainless steel is 0.025% by weight or less. In FIG. 3, the numbers 4, 8, 12, 16, 20, and 24 indicate the ratio of Nas BN/Total N in %. FIG. 3 shows that, in the process of producing a ferritic stainless sheet, the deposit of boron nitride (BN) at a temperature of about 1000° C., which is near the lower limit of the hot rolling temperature, the annealing temperature of hot rolled strip, and the annealing temperature of cold rolled strip, requires a content of boron of 2 ppm or more.

In the ferritic stainless steel of the present invention, an additional alloy component consisting of 0.005% to 0.4% by weight of aluminum may be contained therein. Aluminum is effective for increasing the elongation and the $\bar{r}$ value and for decreasing the ridging height, and, therefore, enhancing the formability, of the resultant ferritic stainless steel. Also, aluminum is effective for enhancing the resistance to acid corrosion and making the size of crystal grains in the stainless steel even so as to make the metallographic properties of the stainless steel uniform. The intensity of the above-mentioned effects of aluminum is variable depending upon the contents of aluminum and boron. Usually, the above-mentioned effects appear when aluminum is added in an amount of 0.005% by weight or more to the ferritic stainless steel. That is, in the range of from 0.005% to 0.4% by weight, the intensity of the above-mentioned effects can increase with the increase in the amount of the added aluminum. However, an excessive amount of aluminum, more than 0.4% by weight, does not contribute or, sometimes, negatively contributes to increasing the above-mentioned effects of aluminum. The only result is to increase the cost of the resultant ferritic stainless steel. Accordingly, the additional component is used in an amount of from 0.005% to 0.4% by weight, preferably, from 0.01% to 0.30% by weight.

The boron- and aluminum-containing ferritic stainless steel of the present invention may contain a further additional alloy component consisting of at least one member selected from the group consisting of titanium, niobium, vanadium, zirconium, copper, calcium, and cerium. The further additional alloy component is effective for further additionally enhancing the formability, such as deep drawability, of the aluminum-containing ferritic stainless steel of the present invention. This further additional effect is derived from a multiplication of the contributions of boron, aluminum, and the further additional alloy component to the formability-enhancing effect.

Titanium is useful for producing a stable carbo-nitride compound in the ferritic stainless steel. The carbo-nitride compound is effective for making the crystal grain size fine and even and increasing the elongation and toughness of the stainless steel, and, therefore, enhancing the formability such as deep drawability of the stainless steel. Especially, in ferritic stainless steel containing boron and aluminum, titanium is remarkably effective for decreasing the ridging height of the resultant ferritic stainless steel. Also, the addition of titanium allows the contents of boron and aluminum in the ferritic stainless steel to decrease, without degrading the quality of the stainless steel. The above-mentioned effects can be realized when titanium is used in an amount of 0.005% by weight or more. However, in the case of ferritic stainless steel containing boron and aluminum, an excessive addition of titanium more than 0.6% by weight is not effective for enhancing the formability, such as the deep drawability, of the ferritic stainless steel, but only effective for increasing the cost thereof. Accordingly, in the present invention, titanium is used in an amount ranging from 0.005% to 0.6% by weight, preferably, from 0.02% to 0.5% by weight. Niobium, vanadium and zirconium used singly in an amount ranging from 0.005% to 0.4% by weight, produce the same effects thereof as those of titanium.

Additionally, the addition of titanium in an amount of from 0.005% to 0.6% by weight is also effective for imparting an enhanced hot formability to the resultant ferritic stainless steel.

Copper exhibits a different effect from that of titanium in the ferritic stainless steel. That is, copper forms no carbo-nitride compound and there are deposits in the form of metallic copper in the grain boundary regions. However, when copper is deposited, the recrystallization of the stainless steel is remarkably influenced therefrom so as to enhance the formability and deep drawability of the stainless steel. This influence is realized when copper is used in an amount of 0.02% by weight or more. However, an excessive amount of copper, more than 0.50% by weight, causes the hot formability of the resultant ferritic stainless steel to be decreased. This is derived from the characteristic contribution of copper itself to the stainless steel. Accordingly, copper is used in an amount of from 0.02% to 0.50% by weight, preferably, from 0.10% to 0.30% by weight.

Calcium is a strong oxygen-eliminating element and effective for increasing the toughness of the stainless steel and reducing the intensity in anisotropy of the stainless steel by making the non-metallic inclusions in the grain boundary regions spherical. These effects of calcium enhance and make the formability and deep drawability of the ferritic stainless steel uniform. However, an excessive amount of calcium, more than 0.05% by weight, results in disadvantages in that calcium is converted into its oxide and the oxide is located in the grain boundary regions so as to degrade the cleanliness and formability of the resultant ferritic stainless steel. Therefore, calcium is used in an amount of 0.05% by weight or less, preferably in the range of from 0.0005% to 0.01% by weight.

Cerium exhibits similar effects to those of calcium. Therefore, cerium is used in an amount of 0.05% by weight or less, preferably, in the range of from 0.0005% to 0.01% by weight.

The features and advantages of ferritic stainless steel of the present invention will further be illustrated by the following specific examples. However, it should be understood that the examples are only illustrative but are not intended to limit the scope of the present invention in any way.

EXAMPLES 1 THROUGH 20 AND COMPARATIVE EXAMPLES 1 THROUGH 5

In each of the Examples 1 through 20 and Comparative Examples 1 through 5, a ferritic stainless steel consisting of the components as indicated in Table 1 each in an amount as indicated in Table 1 and the balance consisting of iron and unavoidable impurities, was prepared by a conventional ferritic stainless steel-melt-producing process. The resultant steel material was hot rolled by a conventional process. The hot rolled steel strip was converted into a cold rolled steel strip having a thickness of 0.7 mm by a conventional batch type of continuous type annealing procedure of hot rolled strip and cold rolling and final annealing procedures of hot rolled strip.

The batch type annealing procedure (R-type annealing) was carried out by using a batch type annealing furnace at a temperature of from 800° C. to 950° C. for a long period of time of 10 hours. The continuous type annealing procedure (C-type annealing) of hot rolled strip was carried out by using a continuous annealing furnace at a high temperature of from 800° C. to 1050° C. for a relatively short time. For example, the hot rolled steel strip was heated to a temperature or 880° C., held at this temperature for one minute and, then, air- or water-cooled. In another example, the hot rolled steel strip was heated to a temperature of 1000° C., held at this temperature for a few seconds, cooled to 800° C. in two minutes and, finally, air or water cooled.

The batch type and continuous type annealing procedures were effected so that the effects of the annealing procedures were the same as each other.

The properties of the resultant ferritic stainless steel strips are indicated in Table 2.

TABLE 1

| | Component | | | | | | | | | | | |
|---|---|---|---|---|---|---|---|---|---|---|---|---|
| | | | | | | | | | | Additional alloy component | Further additional alloy component | |
| Example No. | C (%) | Si (%) | Mn (%) | P (%) | S (%) | Ni (%) | Cr (%) | N (ppm) | B (ppm) | Al (%) | Type | Amount (%) |
| Example 1 | 0.05 | 0.48 | 0.20 | 0.031 | 0.007 | 0.09 | 16.85 | 109 | 3 | — | | — |
| Example 2 | 0.04 | 0.39 | 0.22 | 0.029 | 0.008 | 0.10 | 16.66 | 108 | 20 | — | | — |
| Example 3 | 0.05 | 0.39 | 0.19 | 0.028 | 0.007 | 0.11 | 16.91 | 119 | 28 | — | | — |
| Example 4 | 0.05 | 0.53 | 0.17 | 0.031 | 0.007 | 0.12 | 16.55 | 112 | 25 | 0.005 | | — |
| Example 5 | 0.04 | 0.49 | 0.20 | 0.030 | 0.007 | 0.13 | 16.56 | 102 | 20 | 0.08 | | — |
| Example 6 | 0.05 | 0.49 | 0.19 | 0.030 | 0.008 | 0.12 | 16.66 | 111 | 8 | 0.13 | | — |
| Example 7 | 0.06 | 0.48 | 0.19 | 0.029 | 0.007 | 0.13 | 16.91 | 121 | 6 | 0.20 | | — |
| Example 8 | 0.05 | 0.49 | 0.18 | 0.028 | 0.006 | 0.14 | 16.68 | 118 | 3 | 0.29 | | — |
| Example 9 | 0.05 | 0.52 | 0.23 | 0.032 | 0.006 | 0.11 | 16.55 | 109 | 10 | 0.15 | Ti | 0.02 |
| Example 10 | 0.06 | 0.49 | 0.18 | 0.029 | 0.007 | 0.12 | 16.53 | 109 | 10 | 0.15 | Ti | 0.25 |
| Example 11 | 0.04 | 0.45 | 0.19 | 0.030 | 0.006 | 0.11 | 16.53 | 135 | 9 | 0.15 | Ti | 0.48 |
| Example 12 | 0.05 | 0.48 | 0.17 | 0.028 | 0.007 | 0.13 | 16.49 | 121 | 5 | 0.08 | Nb | 0.10 |
| Example 13 | 0.04 | 0.47 | 0.18 | 0.029 | 0.008 | 0.12 | 16.59 | 121 | 6 | 0.07 | V | 0.12 |
| Example 14 | 0.04 | 0.46 | 0.20 | 0.028 | 0.008 | 0.13 | 16.61 | 119 | 5 | 0.08 | Zr | 0.14 |
| Example 15 | 0.04 | 0.47 | 0.21 | 0.027 | 0.007 | 0.12 | 16.63 | 131 | 10 | 0.06 | Cu | 0.30 |
| Example 16 | 0.04 | 0.49 | 0.22 | 0.031 | 0.007 | 0.12 | 16.68 | 111 | 8 | 0.07 | Ca | 0.008 |
| Example 17 | 0.05 | 0.51 | 0.23 | 0.030 | 0.008 | 0.11 | 16.91 | 121 | 7 | 0.07 | Ce | 0.006 |
| Example 18 | 0.06 | 0.51 | 0.23 | 0.028 | 0.008 | 0.13 | 16.57 | 114 | 10 | 0.15 | Ti | 0.10 |

TABLE 1-continued

| Example No. | Component C (%) | Si (%) | Mn (%) | P (%) | S (%) | Ni (%) | Cr (%) | N (ppm) | B (ppm) | Additional alloy component Al (%) | Further additional alloy component Type | Amount (%) |
|---|---|---|---|---|---|---|---|---|---|---|---|---|
| | | | | | | | | | | | V | 0.12 |
| Example 19 | 0.05 | 0.47 | 0.19 | 0.027 | 0.007 | 0.10 | 16.61 | 121 | 10 | 0.15 | Ti | 0.06 |
| | | | | | | | | | | | Cu | 0.20 |
| Example 20 | 0.04 | 0.48 | 0.18 | 0.029 | 0.007 | 0.11 | 16.67 | 125 | 8 | 0.07 | Ti | 0.02 |
| | | | | | | | | | | | Ca | 0.005 |
| Comparative Example 1 | 0.04 | 0.49 | 0.18 | 0.030 | 0.006 | 0.11 | 16.49 | 113 | — | — | — | |
| Comparative Example 2 | 0.05 | 0.40 | 0.21 | 0.028 | 0.007 | 0.10 | 16.87 | 117 | 33 | — | — | |
| Comparative Example 3 | 0.04 | 0.38 | 0.18 | 0.027 | 0.008 | 0.12 | 16.90 | 120 | — | 0.005 | — | |
| Comparative Example 4 | 0.05 | 0.38 | 0.22 | 0.030 | 0.007 | 0.11 | 16.65 | 112 | — | 0.04 | — | |
| Comparative Example 5 | 0.04 | 0.51 | 0.22 | 0.031 | 0.007 | 0.13 | 16.67 | 117 | 3 | 0.45 | — | |

TABLE 2

| Example No. | Specific component added | $\bar{r}$ value | Ridging height (μ) | Type of Annealing process applied |
|---|---|---|---|---|
| Example 1 | B | 1.10 | 18 | R |
| Example 2 | B | 1.20 | 17 | R |
| | | 1.23 | 17 | C |
| Example 3 | B | 1.25 | 16 | R |
| Example 4 | B—Al | 1.30 | 16 | R |
| Example 5 | B—Al | 1.35 | 14 | R |
| Example 6 | B—Al | 1.38 | 14 | R |
| | | 1.38 | 14 | C |
| Example 7 | B—Al | 1.40 | 13 | R |
| Example 8 | B—Al | 1.41 | 13 | R |
| Example 9 | B—Al—Ti | 1.45 | 12 | R |
| | | 1.42 | 12 | C |
| Example 10 | B—Al—Ti | 1.50 | 10 | R |
| | | 1.48 | 11 | C |
| Example 11 | B—Al—Ti | 1.52 | 8 | R |
| | | 1.50 | 8 | C |
| Example 12 | B—Al—Nb | 1.29 | 14 | R |
| Example 13 | B—Al—V | 1.28 | 16 | R |
| Example 14 | B—Al—Zr | 1.35 | 13 | R |
| Example 15 | B—Al—Cu | 1.29 | 15 | R |
| Example 16 | B—Al—Ca | 1.28 | 16 | R |
| Example 17 | B—Al—Ce | 1.29 | 17 | R |
| Example 18 | B—Al—Ti—V | 1.50 | 10 | R |
| Example 19 | B—Al—Ti—Cu | 1.30 | 15 | R |
| Example 20 | B—Al—Ti—Ca | 1.47 | 12 | R |
| Comparative Example 1 | — | 1.00 | 25 | R |
| Comparative Example 2 | B | 1.25 | 16 | R |
| Comparative Example 3 | Al | 1.05 | 20 | R |
| Comparative Example 4 | Al | 1.00 | 20 | R |
| Comparative Example 5 | B—Al | 1.38 | 14 | R |

In each of Examples 1 through 20, the ferritic stainless steel strip could be hot rolled, annealed, and cold rolled and, then, final annealed without any difficulty. Also, the resultant ferritic stainless steel strips prepared in accordance with the present invention exhibited a satisfactory $\bar{r}$ value of 1.0 or more and a satisfactory ridging height of 20 microns or less, that is, a satisfactory deep drawability.

In Comparative Example 1, the resultant ferritic stainless steel strip (SUS 430) exhibited a poor $\bar{r}$ value of 1.0 and a large ridging height of 25 microns. That is, this comparative stainless steel strip had an unsatisfactory formability.

In Comparative Example 2, the resultant ferritic stainless steel strip was cracked in the hot rolling procedure. In a separate experiment, it was observed that when boron, aluminum, and titanium were added respectively in the amount of 10 ppm, 0.15%, and 0.25% to the same ferritic stainless steel as that mentioned in Comparative Example 2, the boron, aluminum, and titanium were uniformly deposited in the form of fine particles in the steel strip. From this fact, it is assumed that the grains in the steel strip are recrystallized in the preferable orientation which is effective for enhancing the formability such as deep drawability of the steel strip.

In Comparative Example 3, the resultant ferritic stainless steel strip exhibited an unsatisfactory $\bar{r}$ value and ridging height, and, therefore, a poor formability.

In Comparative Example 4, the resultant ferritic stainless steel exhibited a poor $\bar{r}$ value of 1.0 and an unsatisfactory ridging height of 20 microns.

In Comparative Example 5, the resultant ferritic stainless steel strip contained 0.45% by weight of aluminum, which is larger than the content of aluminum of 0.29% by weight in the ferritic stainless steel described in Example 8. However, the $\bar{r}$ value and the ridging height of the ferritic stainless steel of Comparative Example 5 are similar to or slightly poorer than those of the ferritic stainless steel of Example 8.

Furthermore, Examples 1 through 20 indicated that the ferritic stainless steel strips of the present invention could be annealed by any one of the batch type and continuous type annealing procedures without difficulty. cl EXAMPLES 21 THROUGH 26 AND COMPARATIVE EXAMPLES 6 AND 7

In each of the Examples 21 through 26 and Comparative Examples 6 and 7, a ferritic stainless steel consisting of the components indicated in Table 3 each in an amount indicated in Table 3 and the balance consisting of iron and unavoidable impurities, was prepared by a usual ferritic stainless steel-melt-producing process. The resultant steel material was hot rolled, continuously annealed, cold rolled, and, finally, annealed in the same manner as that described in Example 1. The resultant stainless steel strip had a thickness of 0.7 mm.

The steel strip was subjected to tungsten inert-gas (TIG) arc welding. The resultant welded portions of the steel strip was ground and then, the resultant test piece containing the welded portions was immersed in an aqueous solution of sodium chloride containing 20,000 ppm of chlorine ions at a temperature of 30° C. for 7 days to determine the resistance of the welded portion to intergranular corrosion. The test piece was subjected to a color checking procedure in which the formation of intergranular cracks in the welded portion was observed. The degree of the resistance of the welded portion to intergranular corrosion was represented by the number of the following classes.

| Class No. | |
|---|---|
| 0 | Extremely excellent (No rust and crack were found) |
| 1 | Excellent |
| 2 | Good |
| 3 | Satisfactory for practical use |
| 4 | Poor |
| 5 | Very poor (Welded portion was broken into two) |

The results are indicated in Table 3.

TABLE 3

| Example No. | Component (% by weight) C | Si | Mn | P | S | Ni | Cr | Al | B | N | C + N | Resistance to Corrosion (class) (*) |
|---|---|---|---|---|---|---|---|---|---|---|---|---|
| Example 21 | 0.056 | 0.58 | 0.59 | 0.018 | 0.009 | 0.16 | 16.36 | 0.096 | 12 | 0.0066 | 0.0620 | 1,2,2,2,2,2 |
| Example 22 | 0.055 | 0.60 | 0.58 | 0.018 | 0.009 | 0.16 | 16.37 | 0.095 | 11 | 0.0112 | 0.0670 | 1,2,2,2,2,2 |
| Example 23 | 0.054 | 0.58 | 0.59 | 0.018 | 0.009 | 0.16 | 16.42 | 0.093 | 11 | 0.0184 | 0.0720 | 1,1,1,2,2,2 |
| Comparative Example 6 | 0.023 | 0.53 | 0.51 | 0.020 | 0.007 | 0.16 | 16.60 | 0.115 | 13 | 0.0051 | 0.0281 | 4,4,5,5,5,5 |
| Comparative Example 7 | 0.028 | 0.58 | 0.50 | 0.017 | 0.005 | 0.15 | 16.52 | 0.100 | 13 | 0.0076 | 0.0356 | 3,3,4,4,5,5 |
| Example 24 | 0.043 | 0.58 | 0.50 | 0.016 | 0.005 | 0.15 | 16.54 | 0.111 | 12 | 0.0087 | 0.0517 | 1,2,2,2,2,3 |
| Example 25 | 0.074 | 0.58 | 0.50 | 0.016 | 0.005 | 0.15 | 16.53 | 0.111 | 15 | 0.0081 | 0.0821 | 1,1,1,1,1,2 |
| Example 26 | 0.030 | 0.54 | 0.54 | 0.016 | 0.005 | 0.15 | 16.51 | 0.112 | 15 | 0.0120 | 0.0420 | 2,2,3,3,3,3 |

Note:
(*) The test was repeated 6 times.

In view of Table 3, it is clear that when the sum of the contents of carbon and nitrogen is smaller than 0.04% by weight (Comparative Examples 6 and 7), the resultant steel strip exhibited an unsatisfactory resistance to intergranular corrosion of welded portions thereof.

We claim:

1. A ferritic stainless steel having an excellent formability, which consists essentially of:

0.04% to 0.1% by weight of carbon,
1.0% by weight or less of silicon,
0.75% by weight of less of manganese,
10% to 30% by weight of chromium,
0.5% by weight or less of nickel,
0.0102% to 0.025% by weight of nitrogen,
2 to 30 ppm of boron, and
the balance consisting of iron and unavoidable impurities, the sum of the contents of nitrogen and carbon being 0.0502 % by weight or more.

2. The ferritic stainless steel as claimed in claim 1, wherein the content of nitrogen is up to 0.014% by weight, and the content of carbon is up to 0.07% by weight.

3. The ferritic stainless steel as claimed in claim 1, wherein the content of silicon is 0.20% to 0.90% by weight, the content of manganese is 0.05% to 0.65% by weight, the content of nickel is 0.01% to 0.30% by weight, and the content of boron is 5 to 25 ppm.

4. The ferritic stainless steel as claimed in claim 1, which contains an additional alloy component consisting of from 0.005% to 0.4% by weight of aluminum.

5. The ferritic stainless steel as claimed in claim 4, which contains a further alloy component consisting of at least one number selected from the group consisting of 0.005% to 0.6% by weight of titanium, 0.005% to 0.4% by weight of niobium, 0.005% to 0.4% by weight of vanadium, 0.005% to 0.4% by weight of zirconium, 0.02% to 0.50% by weight of copper, 0.05% by weight or less of calcium, and 0.05% by weight or less of cerium.

* * * * *